252-99 AU 165 EX
10/26/76 OR 3,988,254

United States Patent [19]
Mori

[11] 3,988,254
[45] Oct. 26, 1976

[54] DE-SMUTTING AGENT

[75] Inventor: Teruo Mori, Odawara, Japan

[73] Assignee: Fuji Photo Film Co., Ltd., Minami-ashigara, Japan

[22] Filed: June 14, 1974

[21] Appl. No.: 479,378

[30] Foreign Application Priority Data

June 14, 1973 Japan ..... 48-66362

[52] U.S. Cl. ..... 252/99; 134/3; 156/14; 252/79.1; 252/79.2; 252/100

[51] Int. Cl.[2] ..... C11D 7/56; C11D 7/18

[58] Field of Search ..... 252/99, 100, 79.1, 79.2; 134/3; 156/14

[56] References Cited

UNITED STATES PATENTS

| | | | |
|---|---|---|---|
| 3,373,114 | 3/1968 | Grunwald | 252/79.2 X |
| 3,575,747 | 4/1971 | Cohn et al. | 252/79.2 X |
| 3,634,262 | 1/1972 | Grunwald et al. | 252/100 |
| 3,671,344 | 6/1972 | Chiang et al. | 252/79.2 X |
| 3,732,170 | 5/1973 | Demangeon | 252/99 X |

*Primary Examiner*—Mayer Weinblatt
*Attorney, Agent, or Firm*—Sughrue, Rothwell, Mion, Zinn and Macpeak

[57] ABSTRACT

A de-smutting agent comprising an aqueous solution containing a water-soluble hydrogen peroxymonosulfate and a water-soluble hydrogen sulfate and a method for removing smut from aluminum.

2 Claims, No Drawings

DE-SMUTTING AGENT

BACKGROUND OF THE INVENTION

1. Field of the Invention

The present invention relates to a processing agent (de-smutting agent) for removing smut formed on the surface of aluminum (as used herein, the term "aluminum" includes both aluminum and aluminum alloys) upon etching.

2. Description of the Prior Art

Etching the surface of aluminum with an acid or alkali aqueous solution is conducted in order to remove oils adhering to the surface of aluminum, an oxidation film which cannot be removed by degreasing, scales, and stains penetrating into the aluminum, to smooth a surface-dressed aluminum, to deluster the surface of the aluminum or to make the surface uniform. Specific examples of acids and alkalis used in the above described acid or alkali solutions include, e.g., acids such as hydrofluoric acid, fluorozirconic acid, phosphoric acid, sulfuric acid, hydrochloric acid, acetic acid, etc., and alkalis such as sodium hydroxide, potassium hydroxide, sodium tertiary phosphate, sodium aluminate, a mixture of sodium silicate and the above-described alkali, a mixture of sodium carbonate and the above-described alkali, etc. In general, etching is effected by processing the surface of aluminum with an aqueous solution of the above-described acid or alkali at a concentration of about 1 to 20 % by weight at a solution temperature of about 50° to 90° C for 10 seconds to 30 minutes.

However, etching processing of an aluminum surface using such as aqueous solution of acid or alkali leads to the formation of areas of a black, insoluble residue, or smut, on the surface. When a plating film or a coating film is formed on the smut-containing surface of aluminum, only a poor close adherence results. Therefore, smut-removal is always conducted.

As the processing agent for removing the smut, a highly concentrated aqueous solution of phosphoric acid, nitric acid, sulfuric acid, chromic acid and a mixture thereof are known.

However, the use of such highly concentrated acidic aqueous solution requires a large amount of alkali in order to neutralize and discharge the acidic aqueous solution. In particular, where chromic acid is used, the discharged water must be completely processed since hexavalent chromium ion affects the human body. Furthermore, the use of nitric acid or sulfuric acid entails the defects that a bad-smelling gas is generated. Also, from the standpoint of the production steps, these conventional methods have the defect that the rate of smut removal is slow.

SUMMARY OF THE INVENTION

Therefore, an object of the present invention is to provide a de-smutting agent which requires only simple neutralization processing upon discharge.

Another object of the present invention is to provide a de-smutting agent which does not result in environmental pollution.

A further object of the present invention is to provide a de-smutting agent capable of removing smut at a high rate.

As a result of various investigations to attain the above-described objects, the present invention has been achieved. That is, the present invention provides a de-smutting agent comprising an aqueous solution containing a water-soluble hydrogen peroxymonosulfate, a water-soluble hydrogen sulfate and, if desired, at least one of a polyphosphoric acid and a neutral salt.

DETAILED DESCRIPTION OF THE INVENTION

As the hydrogen peroxymonosulfates (hydrogen peroxymonosulfate, $MHSO_5$, where M is an alkali metal atom or an ammonium group) which can be used in the present invention, any water-soluble hydrogen peroxymonosulfates can be employed. More specifically, illustrative examples are alkali metal hydrogen peroxymonosulfates (the alkali metal being potassium, sodium, lithium, rubidium, cesium, etc.), ammonium hydrogen peroxymonosulfate, etc. Of these, potassium hydrogen peroxymonosulfate and sodium hydrogen peroxymonosulfate are preferred.

On the other hand, as the hydrogen sulfates to be used in the present invention, any water-soluble hydrogen sulfates can be employed. More specifically, suitable examples are, e.g., alkali metal hydrogen sulfates (the alkali metal being potassium, sodium, lithium, rubidium, cesium, etc.), ammonium hydrogen sulfate, etc. In particular, potassium hydrogen sulfate and sodium hydrogen sulfate are preferred. The hydrogen sulfates can be contained in the de-smutting agent of the present invention by dissolving sulfuric acid and a water-soluble sulfate such as an alkali metal or ammonium sulfate in equivalent amounts in water, as well as by dissolving the above-described water-soluble hydrogen sulfates in water.

The amount of the aforesaid hydrogen peroxymonosulfate preent in the de-smutting agent of the present invention is about 0.1 to 10 % by weight, preferably 0.2 to 5 % by weight. If the amount of the hydrogen peroxymonosulfate is less than about 0.1 % by weight, the smut-removal effect is not sufficient, while if the amount is higher than about 10 % by weight, the cost is too high. Also, the aforesaid hydrogen sulfate present in the de-smutting agent of the present is used in such amount that the de-smutting agent is acidic, preferably, in an amount of not less than about 0.01 mol/liters, e.g., about 0.5 to 60 % by weight, most preferably not less than 0.1 mol/liter, e.g., 10 to 30 % by weight.

The de-smutting agent of the present invention can further contain a neutral water-soluble salt and/or a polyphosphoric acid to thereby increase the smut-removing rate to an even greater extent. Suitable neutral salts are, e.g., the alkali metal and ammonium sulfates such as sodium sulfate, potassium sulfate, lithium sulfate, ammonium sulfate, etc., the alkali metal nitrates such as sodium nitrate, potassium nitrate, etc., and the alkali metal chlorides such as potassium chloride, sodium chloride, etc. Of these, the above-described sulfates are particularly preferred. As the above-described polyphosphoric acid, any of those phlyphosphoric acids which have two or more phosphorus atoms in the same molecule can be used. Specific examples of suitable polyphosphoric acids include $H_4P_2O_7$, $H_5P_3O_{10}$, $H_6P_4O_{13}$, etc. Of these, $H_6P_4O_{13}$ is preferable for the present invention.

The above-described neutral salts or polyphosphoric acids are preferably contained in the de-smutting agent at a range of from about 1 to 10 % by weight. However, no difficulties are encountered if an amount of greater than about 10 % up to the saturation concentration is present.

Furthermore, the de-smutting agent of the present invention can contain, if desired, a water-miscible organic solvent, e.g., alcohols such as methanol, ethanol, isopropanol, diacetone alcohol, etc.; ketones such as acetone, methyl ethyl ketone; glycol ethers such as ethyleneglycolmonomethylether, ethyleneglycolmonoethylether, acetic acid 2-methoxyethyl dimethylsulfoxide, dioxane, tetrahydrofuran, etc.; with methanol, ethanol, isopropanol, acetone, ethyleneglycolmonomethylether, ethyleneglycolmonoethylether and acetic acid 2-methoxyethyldimethylsulfoxide being preferred.

The method of processing the surface of aluminum using the de-smutting agent of the present invention is described below.

First, the surface of aluminum is etched using a solution of an acid (such as hydrofluoric acid, fluorozirconate, phosphoric acid, sulfuric acid, hydrochloric acid, preferably phosphoric acid or sulfuric acid) or an alkali (such as soduum hydroxide, potassium hydroxide, trisodium phosphate, sodium aluminate, sodium silicate, sodium carbonate, etc., preferably sodium hydroxide, sodium silicate or sodium carbonate). This etching can be effected in a conventional known manner, and the use of the de-smutting agent of the present invention requires no special techniques. The etching-processed aluminum is then washed with water. In particular, where etching is effected using an alkali solution, washing is sufficiently conducted, preferably until the discharged water is no longer alkaline. As the washing methods, various methods can be employed, with immersion, washing with running water and spray washing being generally conducted. Using immersion, the processing time for sufficient washing is about 10 seconds to 10 minutes and, with the washing using running water or spray washing, about 10 seconds to 5 minutes.

The thus etched and washed aluminum is then processed with the de-smutting agent of the present invention to remove smut formed upon etching. Any processing method in which the surface of aluminum is contacted with the de-smutting agent of the present invention can be employed. However, immersion, spraying, and the like are generally conducted. Suitable processing conditions are a solution temperature of about 5 to 40° C, preferably 15°–30° C, and a processing time of about 1 second to 10 minutes, preferably 5 seconds to 3 minutes.

Aluminum which can be surface-processed with the de-smutting agent of the present invention includes pure aluminum and aluminum alloys. Various aluminum alloys can be treated. For example, aluminum alloys with silicon, copper, manganese, magnesium, chromium, zinc, lead, bismuth, nickel or a like metal can be treated. Specific examples of aluminum alloys are tabulated below. The percents in the table are by weight, and the balance is aluminum.

| Aluminum Alloy | Si | Cu | Mn | Mg | Cr | Zn |
|---|---|---|---|---|---|---|
| 2S | 0.4 | — | — | 0.6 | — | — |
| 3S | — | — | 1.2 | — | — | — |
| 24S | — | 4.5 | 0.6 | 1.5 | — | — |
| 52S | — | — | — | 2.5 | 0.25 | — |
| 61S | 0.6 | 0.25 | — | 1.0 | 0.25 | — |
| 75S | — | 1.60 | — | 2.50 | 0.30 | 5.60 |

These compositions further contain some iron, titanium and other negligible impurities not indicated above.

The smut-removing rate using the de-smutting agent of the present invention is rapid. Therefore, the de-smutting agent can be used as a dilute solution, which requires less alkali to neutralize the solution upon discharge. That is, the absolute amount of chemicals to be discharged is reduced. This is advantageous from the standpoint of prevention of environmental pollution. The use of a conventional de-smutting agent such as nitric acid, sulfuric acid-chromic acid or the like inevitably degrades the working environment, resulting in a reduction in working efficiency of the workers and in low safety. In contrast, the de-smutting agent of the present invention does not degrade the working environment and provides high safety. In addition, the de-smutting agent of the present invention enables the time necessary for processing the surface of aluminum to be shortened since smut is removed at a high rate. Furthermore, while an anodic oxidation film or a plating film formed on the surface of aluminum etched and processed with a de-smutting agent of sulfuric acid-chromic acid to remove smut does not show good properties, aluminum surface-processed using the de-smutting agent of the present invention provides a good quality oxidation film. Therefore, an aluminum plate surface-processed using the de-smutting agent of the present invention provides a good support for a planographic printing plate. Furthermore, other coating layers including a plated film are closely adhered to the surface of aluminum surface-processed using the de-smutting agent of the present invention.

The present invention will now be illustrated in greater detail by reference to the following non-limiting examples of preferred embodiments of the present invention. In the examples, all parts, percents, ratios and the like are by weight, unless otherwise indicated.

EXAMPLE 1

0.3 mm-thick aluminum plates (3S) were immersed in a 10 % aqueous solution of sodium tertiary phosphate (dodecahydrate) at 70° C for 1 minute to effect etching, then washed with running water (20° C) for 1 minute. A great amount of black smut adhered to the aluminum surface. Each of these aluminum plates was immersed in a de-smutting agent (solution temperature: 20° C) having the composition shown in Table 1 to measure the smut-removal rate of each de-smutting solution.

The smut-removal rate was measured as follows. That is, first, half of the aluminum plate was immersed in the de-smutting agent to remove the smut and expose the white texture of the aluminum plate. Then, the remaining half was immersed and the time necessary for this remaining part to become as white as the part from which the smut was first removed was determined. This time was taken as the smut-removing rate.

The results thus obtained are shown in Table 1. Additionally, De-smutting Agents 8 and 9 are conventional de-smutting agents, which are shown for the purpose of comparison.

TABLE 1

| | De-smutting Agent | | | | | | | | |
|---|---|---|---|---|---|---|---|---|---|
| | 1 | 2 | 3 | 4 | 5 | 6 | 7 | 8 | 9 |
| Potassium Hydrogen Peroxymonosulfate (g) | 20 | 20 | 20 | 5 | 5 | 5 | 20 | — | — |
| Potassium Hydrogen Sulfate (g) | 60 | 60 | 60 | 75 | 75 | 75 | 60 | — | — |
| Potassium Sulfate (g) | — | 20 | 20 | — | 20 | 20 | — | — | — |
| Polyphosphoric Acid ($H_6P_4O_{13}$) (g) | — | — | 30 | — | — | 30 | 30 | — | — |
| Chromic Acid (g) | — | — | — | — | — | — | — | 50 | — |
| Conc. Sulfuric Acid (36N) (g) | — | — | — | — | — | — | — | 300 | — |
| Conc. Nitric Acid (specific gravity: 1.38) (g) | — | — | — | — | — | — | — | — | 500 |
| Water (g) | 1000 | 1000 | 1000 | 1000 | 1000 | 1000 | 1000 | 1000 | 500 |
| Smut-removal Rate (seconds) | 2.0 | 1.8 | 1.3 | 2.3 | 2.1 | 1.5 | 1.5 | 3.0 | 2.5 |

From the results in Table 1, it can be seen that, as compared with the conventional De-smutting Agents 8 and 9, De-smutting Agents 1 to 7 of the present invention exhibited a faster smut-removal rate, and that the concentration of each ingredient contained in the de-smutting agents of the present invention was markedly less than the concentration in the conventional de-smutting agents.

Also, it can be seen that, when potassium sulfate and/or polyphosphoric acid is present in the de-smutting agent of the present invention, the smut-removal rate is faster.

EXAMPLE 2

A 0.2 mm-thick aluminum plate (2S) was immersed in a 5 % aqueous solution of sodium tertiary phosphate (dodecahydrate) at 70° C for 1 minute to etch the aluminum plate, followed by washing with 20° C running water.

A large amount of black smut was adhered to the aluminum surface. This aluminum plate was immersed in De-smutting Agent 10 having the following composition at 20° C for 10 seconds. As a result, black smut was completely removed from the surface of the aluminum plate to expose the white texture of the aluminum.

De-smutting Agent 10

| | |
|---|---|
| Potassium Hydrogen Peroxymonosulfate | 5 g |
| Potassium Hydrogen Sulfate | 10 g |
| Water | 1000 ml |

Then, this aluminum plate was immersed in a 5 % sodium silicate aqueous solution at 70° C for 1 minute and washed with running water at 20° C for 1 minute, followed by drying. On this aluminum plate was coated a light-sensitive solution having the following composition in an amount of about 1.0 g/m² using a whirler, followed by drying. Thus, a light-sensitive printing plate was obtained.

| | Parts by Weight |
|---|---|
| Shellac | 18 |
| Xylene Resin (Nikanol HP120, made by Mitsubishi Gas Chemicals Co., Ltd.) | 3 |
| Diazo Resin (1:1 weight ratio condensate of p-diazodiphenylamine p-toluenesulfonate and formaldehyde) | 3 |
| Furfuryl Alcohol | 50 |

-continued

| | Parts by Weight |
|---|---|
| Methanol | 300 |

This light-sensitive printing plate was exposed through an original using a "Plano PS Printer A3" (made by the Fuji Photo Film Co., Ltd.), and immersed in an aqueous solution having the following composition at 25° C for 1 minute to develop.

| | |
|---|---|
| Methanol | 300 g |
| Sodium Tertiary Phosphate (dodecahydrate) | 5.0 g |
| Water | 700 g |

Thus, an excellent printing plate was obtained.

With the aluminum plates from which smut was not removed or which were processed with the de-smutting agent for too short a time, difficulties such as poor development, areas in the image areas which were unaffected, and the like were encountered.

On the other hand, where a 10N nitric acid aqueous solution was used as a de-smutting agent, an excellent printing plate as in the case of De-smutting Agent 10 was obtained. However, as to the amount of alkali necessary for neutralization, per unit quantity, for processing the discharged de-smutting agent, the amount of alkali in the case of the 10N nitric acid aqueous solution was about 80 times larger than the amount used in the case of De-smutting Agent 10. Furthermore, a 10N nitric acid aqueous solution generated a bad-smelling gas and, on contact with the human body or clothes, changed them yellow or deteriorated them. On the other hand, De-smutting Agent 10 did not give out a bad smell and, when clothes or part of human body were immersed in the solution, no detrimental influences resulted. Thus, a very high workability and safety were attained.

EXAMPLE 3

A 0.3 mm-thick aluminum plate (3S) was immersed in a 10 % sodium hydroxide aqueous solution at 60° C for 3 minutes and, after being washed with running water (25° C) for 1 minute, immersed in De-smutting Agent 11 having the following composition at 20° C for 25 seconds. Thus, black smut was removed from the surface of the aluminum plate to obtain a white aluminum surface.

De-smutting Agent 11

| | |
|---|---|
| Potassium Hydrogen Peroxymonosulfate | 10 g |
| Potassium Hydrogen Sulfate | 50 g |
| Potassium Sulfate | 20 g |
| Water | 1000 ml |

This aluminum plate was subjected to anodic oxidation in a 10 % sulfuric acid aqueous solution (20° C) at a direct electric current density of 2 A/dm$^2$. After being washed with running water at 25° C for 1 minute, the plate was immersed in a 5 % sodium silicate aqueous solution at 70° C for 2 minutes, followed by washing with running water at 25° C. Furthermore, the plate was coated with the same light-sensitive solution as described in Example 2 in the same manner as described in Example 1, dried, exposed and developed. Thus, a printing plate containing good images was obtained. With the aluminum plate from which the smut had not been removed, the development result was bad, which might be attributed to the existence of heterogeneous areas in the oxidation film formed upon anodic oxidation. When printing was conducted using this bad printing plate, non-image areas were seriously stained.

On the other hand, when a de-smutting agent prepared by mixing 100 g of 36N concentrated sulfuric acid, 200 g of chromic acid and 700 g of water was used in place of the above-described De-smutting Agent 11, an innumerable number of spots was generated on the aluminum surface upon formation of the anodic oxidation film, which might be attributed to chromium remaining on the aluminum surface. When a printing plate was similarly prepared using this aluminum plate, development was not very good at the spot areas.

Also, in processing the discharged solution, this sulfuric acid-chromic acid de-smutting agent was subjected to the following steps; first, hexavalent chromium ion was reduced to trivalent chromium ion using ferrous sulfate; then it was neutralized with calcium hydroxide; and the precipitate thus formed was filtered out. Therefore, the steps for processing the discharged solution are complicated as compared with the steps for De-smutting Agent 11.

EXAMPLE 4

A 0.2 mm-thick aluminum plate (3S) was immersed in a 8 % aqueous solution of sodium tertiary phosphate (dodecahydrate) at 70° C for 2 minutes. After being washed with running water at 20° C, the plate was immersed in De-smutting Agent 12 having the following composition for 1 minute. Thus, black smut was removed to obtain a white aluminum surface.

De-smutting Agent 12

| | |
|---|---|
| Potassium Hydrogen Peroxymonosulfate | 20 g |
| Potassium Hydrogen Sulfate | 60 g |
| Potassium Sulfate | 30 g |
| Polyphosphoric Acid ($H_6P_4O_{13}$) | 20 g |
| Water | 1000 ml |

This aluminum plate was washed with running water at 20° C for 1 minute, then immersed in a solution having the following composition at 20° C for 30 seconds.

| | |
|---|---|
| Sodium Hydroxide | 120 g |
| Zinc Oxide | 20 g |
| Sodium Potassium Tartrate | 50 g |
| Ferric Chloride | 2 g |
| Sodium Nitrate | 1 g |
| Water | 1000 g |

This aluminum plate was washed with running water at 20° C for 1 minute, and subjected to electroplating for 2 minutes by immersion in the following copper plating bath.

| | |
|---|---|
| Copper Pyrophosphate | 94 g |
| Potassium Pyrophosphate | 340 g |
| Aqueous Ammonia | 3 cc |
| Water | 800 ml |

The solution temperature was 55° C, and the cathode electric current density was 3 A/dm$^2$. Thus, a copper-plated surface, good in both luster and smoothness, was obtained.

When the same test was conducted using 10N nitric acid in lieu of De-smutting Agent 12, an excellent plated surface as in the case of using De-smutting Agent 12 was obtained. However, as is shown in Example 2, 10N nitric acid is not preferable from the standpoint of public sanitation and worker safety.

On the other hand, when the same test was conducted except for processing at 25° C for 2 minutes using a de-smutting agent a mixture comprising 100 g of sulfuric acid, 200 g of chromic acid and 700 g of water, the resulting plated surface delaminated.

EXAMPLE 5

A 0.5 mm-thick aluminum plate (copper content: 0.12 %) was immersed in a 10 % sodium hydroxide aqueous solution, maintained at 50° C, for 1 minute, followed by washing with 20° C running water for 1 minute. Then, the plate was immersed in De-smutting Agent 13 having the following composition at 20° C for 1 minute, followed by washing with running water at 20° C. Thus, a white aluminum plate was obtained.

De-smutting Agent 13

| | |
|---|---|
| Potassium Hydrogen Peroxymonosulfate | 30 g |
| Potassium Hydrogen Sulfate | 15 g |
| Potassium Sulfate | 15 g |
| Sodium Hydrogen Sulfate | 40 g |
| Polyphosphoric Acid ($H_6P_4O_{13}$) | 20 g |
| Sodium Sulfate | 5 g |
| Water | 1000 ml |

This aluminum plate was subjected to anodic oxidation at 50° C and at direct electric current density of 2A/dm$^2$ for 35 minutes in an aqueous solution containing 5 % oxalic acid and 3 % potassium oxalate.

After being washed with running water at 20° C for 1 minute, this aluminum plate was dried and immersed in a silver nitrate solution having the following composition at 25° C for 1 minute.

| | |
|---|---|
| Silver Nitrate | 300 g |
| Gelatin | 5 g |
| Concentrated Nitric Acid (specific gravity: 1.38) | 1 ml |

-continued

| | |
|---|---|
| Distilled Water | 1000 ml |

Excess solution on the aluminum surface was squeezed off with a roller and, after being dried, the aluminum plate was immersed in a solution having the following composition at 25° C for 2 seconds.

| | |
|---|---|
| Potassium Bromide | 50 g |
| Potassium Ferricyanide | 50 g |
| Distilled water | 1000 ml |

Excess solution was squeezed off with a roller and the plate was dried to produce a light-sensitive aluminum plate. After being exposed for 20 seconds using a "Plano PS Printer A3" (made by the Fuji Photo Film Co., Ltd.), the aluminum plate was immersed in a developer having the following composition at 20° C for 20 seconds for development, followed by washing with running water for 1 minute. The thus obtained image was quite satisfactory.

| | |
|---|---|
| Sodium Sulfite (anhydrous) | 120 g |
| Hydroquinone | 30 g |
| 1-Phenyl-3-pyrazolidone | 2.1 g |
| Sodium Thiosulfate ($5H_2O$) | 50 g |
| Potassium Thiocyanate | 1.8 g |
| Sodium Hydroxide | 20 g |
| Ethylenediamine | 0.3 g |
| 1-Phenyl-5-mercaptotetrazole | 1.0 g |
| Water | 1000 ml |

On the other hand, when images were formed in the same manner as described above except that the processing with the de-smutting agent was omitted, a number of white spots were generated at the image areas.

Also, when images were formed in the same manner as described above except for processing the aluminum plate with 10N nitric acid in place of the above-described de-smutting agent at 20° C for 1 minute to remove smut, fine pin-hole-like spots were formed in the image areas.

Furthermore, when images were formed in the same manner as described above, except for processing the plate with the sulfuric acid-chromic acid as described in Example 3 in place of the nitric acid at 20° C for 2 minutes to remove smut and immersing the plate in running water at 20° C for 1 minute, fogs were formed in non-image areas.

While the invention has been described in detail and with reference to specific embodiments thereof, it will be apparent to one skilled in the art that various changes and modifications can be made therein without departing from the spirit and scope thereof.

What is claimed is:

1. A method of removing smut from aluminum comprising treating the surface of said aluminum with a de-smutting agent consisting essentially of an aqueous solution containing at least 0.1% by weight of a water-soluble hydrogen peroxy-monosulfate of the formula $MHSO_5$ wherein M is an alkali metal ion or an ammonium group and at least 0.1 mol/liter of a water-soluble hydrogen sulfate so that the de-smutting agent is acidic.

2. The method of claim 1 wherein said de-smutting agent contains at least one of a polyphosphoric acid having two or more phosphorous atoms in the same molecule and a water-soluble neutral salt.

* * * * *